US007838775B2

(12) United States Patent
Montena

(10) Patent No.: US 7,838,775 B2
(45) Date of Patent: Nov. 23, 2010

(54) COVER FOR CABLE CONNECTORS

(75) Inventor: Noah Montena, Syracuse, NY (US)

(73) Assignee: John Mezzalingua Associates, Inc., East Syracuse, NY (US)

( * ) Notice: Subject to any disclaimer, the term of this patent is extended or adjusted under 35 U.S.C. 154(b) by 0 days.

(21) Appl. No.: 12/414,255

(22) Filed: Mar. 30, 2009

(65) Prior Publication Data

US 2010/0248533 A1 Sep. 30, 2010

(51) Int. Cl.
*H01B 17/58* (2006.01)

(52) U.S. Cl. ..... 174/138 F; 439/523

(58) Field of Classification Search ..... 439/521–523, 439/277, 519, 125, 559–558; 174/138 F
See application file for complete search history.

(56) References Cited

U.S. PATENT DOCUMENTS

| | | | | | |
|---|---|---|---|---|---|
| 2,946,839 | A | * | 7/1960 | Horning | 174/93 |
| 3,390,375 | A | * | 6/1968 | Salmonson | 439/894 |
| 3,528,051 | A | * | 9/1970 | Cooper et al. | 439/447 |
| 3,753,192 | A | * | 8/1973 | Urani | 337/201 |
| 3,861,777 | A | | 1/1975 | Clark | |
| 4,173,385 | A | | 11/1979 | Fenn et al. | |
| 4,224,464 | A | | 9/1980 | Bunnell et al. | |
| 4,283,597 | A | * | 8/1981 | Cooper, Jr. | 174/138 F |
| 4,325,600 | A | * | 4/1982 | Nestor | 439/523 |
| 4,593,962 | A | | 6/1986 | Knorreck et al. | |
| 4,822,293 | A | | 4/1989 | Robson | |
| 4,998,894 | A | * | 3/1991 | Gronvall | 439/521 |
| 5,132,495 | A | * | 7/1992 | Ewing et al. | 174/138 F |
| 5,502,280 | A | | 3/1996 | Rocci et al. | |
| 5,816,853 | A | * | 10/1998 | Buekers et al. | 439/521 |
| 5,844,171 | A | * | 12/1998 | Fitzgerald | 174/92 |
| 5,857,865 | A | | 1/1999 | Shimirak et al. | |
| 6,162,087 | A | * | 12/2000 | Hiura | 439/521 |
| 6,273,733 | B1 | | 8/2001 | Uchiyama | |
| 6,929,265 | B2 | | 8/2005 | Holland et al. | |
| 6,942,520 | B2 | | 9/2005 | Barlian et al. | |
| 7,179,100 | B2 | | 2/2007 | Montena | |
| 7,186,127 | B2 | | 3/2007 | Montena | |
| 7,402,063 | B2 | | 7/2008 | Montena | |
| 2006/0286862 | A1 | * | 12/2006 | Lubinsky et al. | 439/521 |

* cited by examiner

*Primary Examiner*—Michael C Zarroli
(74) *Attorney, Agent, or Firm*—George R. McGuire; Bond Schoeneck & King, PLLC

(57) ABSTRACT

A cover/boot and a system of covers/boots for placement in sealed relation over a connector or pair of connectors that is or are adapted to terminate a cable or splice together a pair of cables, preferably cables that carry signals received by a receiving apparatus on a cell tower. The covers include a cable end that sealingly receives a cable therein, an elongated body that provides secure cover to a cable connector, and an end that abuts a bulkhead or sealingly engages with a second cover when used in a splicing application.

13 Claims, 14 Drawing Sheets

COVER FOR CABLE CONNECTORS

BACKGROUND OF THE INVENTION

The present invention relates generally to covers for cable connectors, and more particularly to covers that protect cable connectors used on cell towers from environmental degradation.

Cell towers contain antennas, transceivers and other wireless signal receiving apparatus mounted thereon from which a cable accepts and distributes the signal to a predetermined destination. Cell towers may be free-standing or mounted to a roof, pole, or other structure. Regardless, the cell towers and components mounted thereon are open to the environment and thus susceptible to degradation from weather related corrosive effects (e.g., moisture infiltration), pollution, debris and other elements. Degradation of the components potentially leads to degradation of the signal quality being transmitted through the cables that carry the wirelessly received signals at the cell tower.

To protect the components from environmental effects, layers of tape have been used to cover and seal the components, creating what have conventionally been referred to as tape-wrap seals. The tape layers typically consist of a first layer of electrical tape, followed by a layer of butyl tape, and then followed by another layer of electrical tape. While the layering of tape does in certain instances provide for a secure seal, it is not without its drawbacks.

First, the taping requires significant time in its initial installation, and needs to be removed in order to gain access to the component when servicing the components (and then reapplied after servicing is complete). The time associated with the taping and removal thereof when servicing the components is costly. In addition, the quality of the seal is dependant on the skill of the worker that is applying the tape. As such, inconsistent application of the tape may lead to instances of ineffective sealing of components.

Second, the properties inherent in the material composition of the tape subjects the tape to size fluctuation and inconsistent adherence. If the tape contracts in colder temperatures and loses adherence strength in warmer temperatures, for example, the quality of the seal created through the tape becomes compromised in regions that experience wide temperature fluctuation. In addition, the same pollutants and other environmental factors that affect the components when unsealed may also affect the sealing quality of the tape.

In addition to taping as a sealing provision, plastic clamshell or valise type covers have been used to envelop the components. These style covers are exemplified by the plastic material composition and the closure mechanisms used to open and close them around the components. While the opening and closing of the clamshell style cover facilitates quicker installation and removal in repair situations, it too is not without its drawbacks. For instance, the plastic material becomes brittle in colder temperatures, and this reduction in ductility increases over time. As the material becomes more brittle, the closure mechanisms lose their effectiveness often breaking or otherwise not reliably performing the closure function for which they were designed. Furthermore, the clamshell style closures include seams that extend essentially the entire periphery of the cover, making the sealing function much more difficult when compared to covers that do not include such long seams between parts. As such, the clamshell style covers lose their sealing effectiveness over time and in climates that routinely experience cold temperatures.

It is a principal object and advantage of the present invention to provide a cell tower component cover that may be quickly installed and/or removed in sealing relation to components mounted on cell towers.

It is a further object and advantage of the present invention to provide a cell tower component cover that maintains its sealing properties regardless of temperature fluctuations.

It is an additional object and advantage of the present invention to provide a cell tower component cover that may be used as a redundant seal in addition to pre-existing internal seals existent in connectors.

Other objects and advantages of the present invention will in part be obvious, and in part appear hereinafter.

SUMMARY OF THE INVENTION

In accordance with the foregoing objects and advantages, a first aspect of the present invention provides a cover for a connector adapted to terminate a cable, wherein the connector includes a body portion and a coupler element. The cover essentially comprises an elongated body member extending along a longitudinal axis and having cable and bulkhead ends, and interior and exterior surfaces; a plurality of spaced apart grooves formed in a predetermined region of the interior surface of the body member, proximate the cable end; wherein the interior surface of the body member is adapted to sealingly envelop the connector.

A second aspect of the present invention provides a cover for a connector adapted to terminate a signal carrying cable, wherein the connector includes a body portion and a coupling element and is adapted to terminate in a bulkhead with a shank portion extending outwardly therefrom. The cover comprises an elongated body member having proximal and distal ends, interior and exterior surfaces, and extends along a longitudinal axis. The interior surface of the cover includes a first region adapted to cover at least a portion of the signal carrying cable and extending from the proximal end to a first shoulder, the first region being of a minimum, first cross-sectional diameter, a medial region adapted to cover at least the connector body portion and nut and that extends from the first shoulder to a second shoulder, the second region being of a minimum, second cross-sectional diameter that is greater than the minimum, first cross-sectional diameter, and a third region adapted to cover the shank portion and that extends from the second shoulder to the distal end, the third region being of a minimum, third cross-sectional diameter that is greater than the minimum, second cross-sectional diameter. The cover is composed of a rubber material, preferably a silicone rubber. The first region of the cover's interior surface includes a plurality of grooves formed therein, wherein each of the grooves extends in spaced parallel relation to the others, the grooves serving primarily as reservoirs for any moisture that may migrate into the cover. The exterior surface of the cover includes at least one wing formed on the exterior surface that serves as a gripping surface for a tool or manual engagement (e.g., fingers) used to remove the cover from a connector by axial sliding of the cover.

A third aspect of the present invention provides a cover for a connector adapted to terminate a cable, wherein the connector includes a body portion and a coupling element (e.g., a nut), and is adapted to terminate in a bulkhead that includes a shank portion extending outwardly therefrom. The cover essentially comprises an elongated body member that extends along a longitudinal axis and includes cable and bulkhead ends, and interior and exterior surfaces. The interior surface includes a first region adapted to cover at least a portion of the signal carrying cable and extends from the cable end to a first shoulder, with the first region being of a minimum, first cross-sectional diameter; a second region adapted to cover at least the connector body portion and extend from the first shoulder to a second shoulder, with the second region being of an minimum, second cross-sectional diameter that is greater than the minimum, first cross-sectional diameter; a third region adapted to cover at least the nut and extend from the second shoulder to a third shoulder, with the third region being of a minimum, third cross-sectional diameter that is larger than the second cross-sectional diameter; and a fourth region adapted to cover the shank portion and that extend from the third shoulder to the bulkhead end, with the fourth region being of a minimum, fourth cross-sectional diameter that is greater than said minimum, third cross-sectional diameter. The cover further comprises a ring formed on the exterior surface that extends in a plane that is transverse to the longitudinal axis.

A fourth aspect of the present invention provides a system for covering a first connector adapted to terminate a first cable, and further covering a second connector adapted to terminate a second cable. The system of covers essentially comprises a first elongated body member extending along a longitudinal axis and comprising cable and splice ends, interior and exterior surfaces, and adapted to envelop at least a portion of the first connector; a second elongated body adapted to telescopically engage the first elongated body member in enveloping relation to the second connector. The second elongated body member adapted to envelop the second connector comprises cable and splice ends, interior and exterior surfaces, and extends co-axially from the first body member when engaged therewith, and further comprises an annular flange that extends about said exterior surface thereof, an upper segment that extends upwardly from said annular flange and a lower segment that extends downwardly from said annular flange. A portion of the upper segment of the first elongated body is adapted to be positioned between the interior surface of the first elongated body member and the first connector.

BRIEF DESCRIPTION OF THE DRAWINGS

The present invention will be more fully appreciated and understood by reading the following Detailed Description in conjunction with the accompanying drawings, in which.

DETAILED DESCRIPTION

Figure 1:
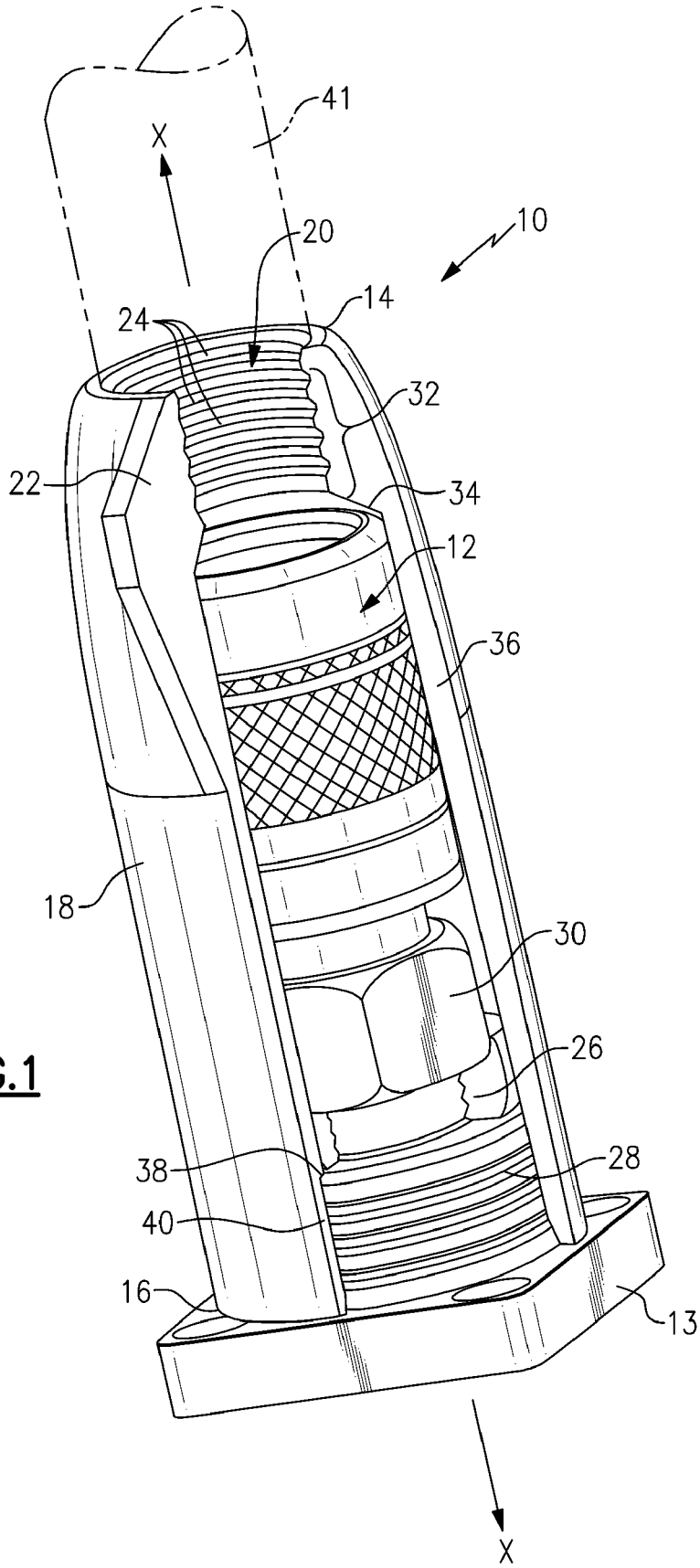
FIG. 1 is a partially cut-away perspective view of a first embodiment of a cover for a first cable connector.
Figure 2:
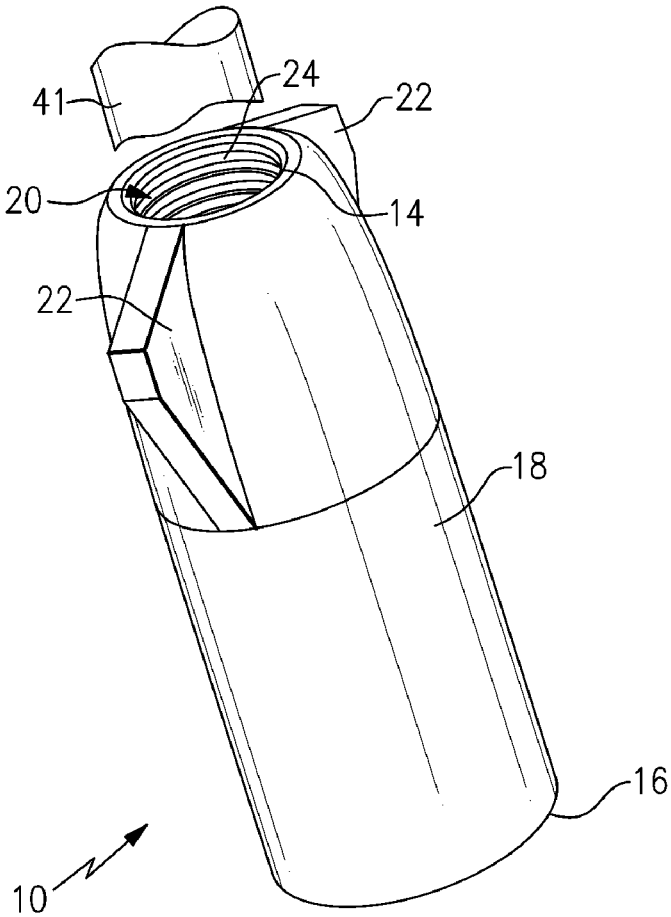
FIG. 2 is a partially exploded perspective view thereof.
Figure 2:
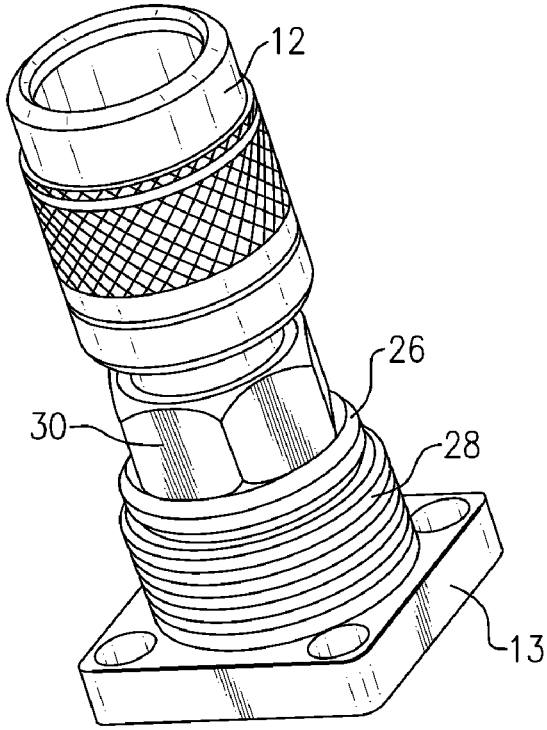
Figure 3:
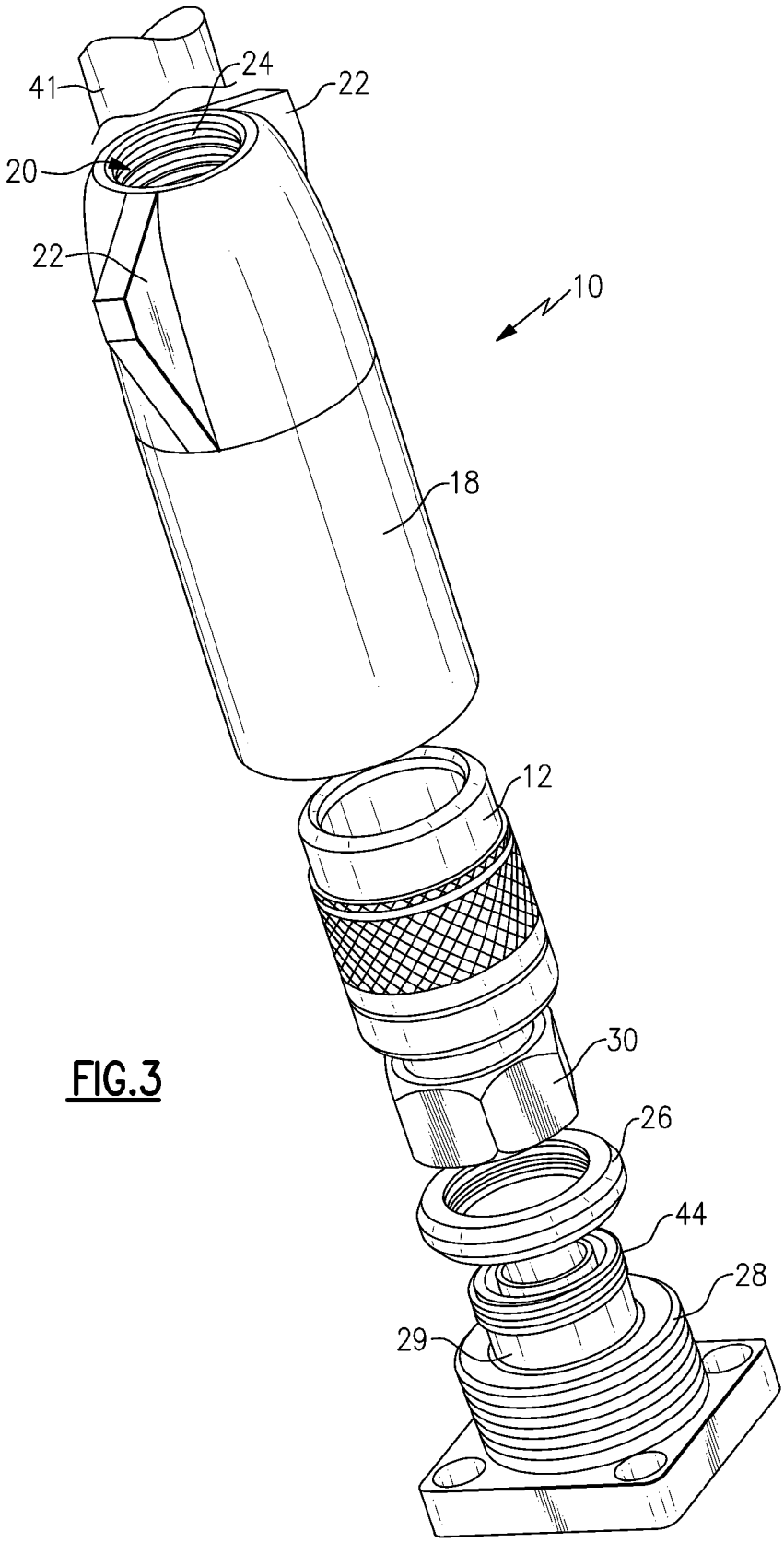
FIG. 3 is a fully exploded perspective view thereof.
Figure 4:
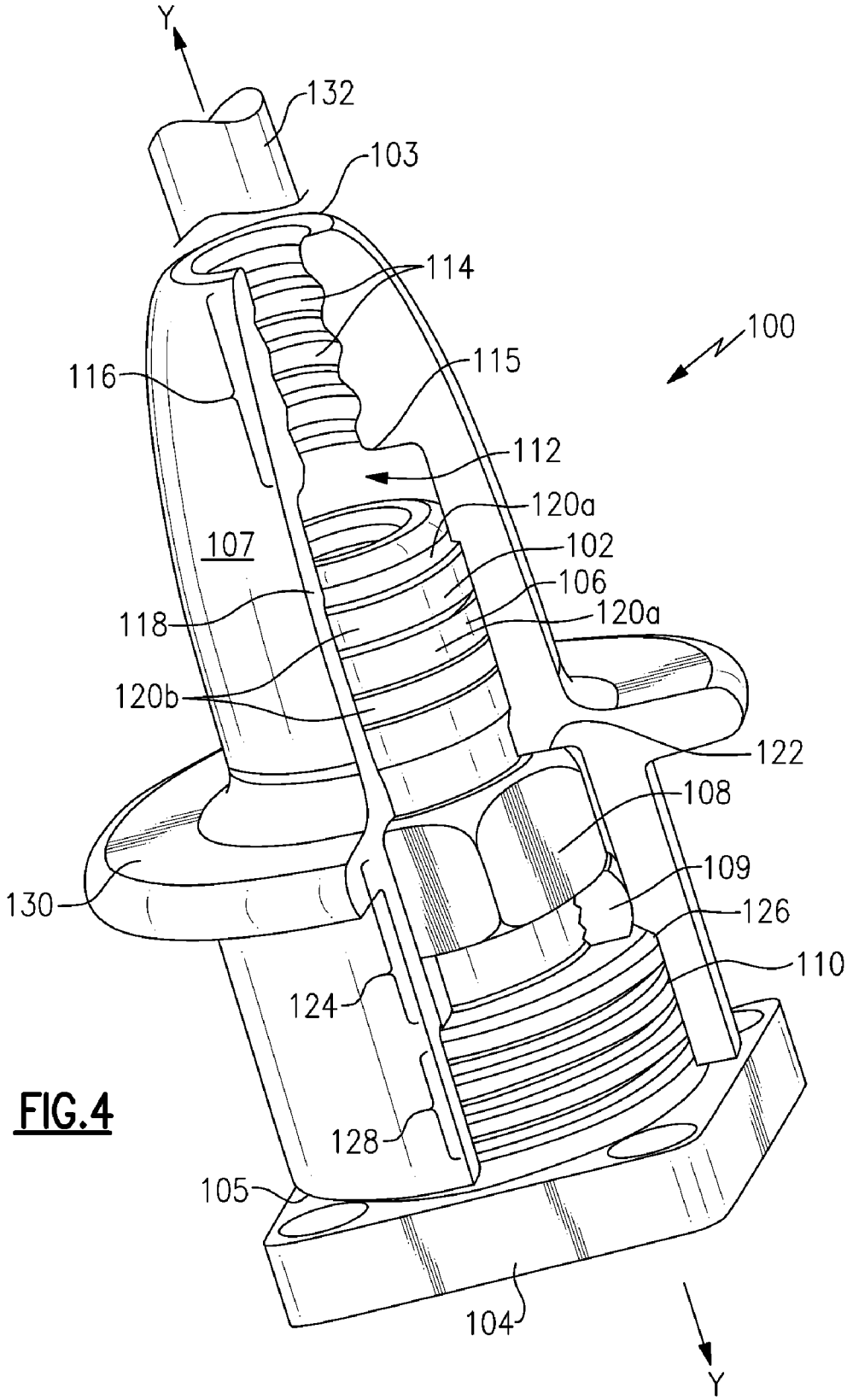
FIG. 4 is a partially cut-away perspective view of a second embodiment of a cover for a second cable connector.
Figure 5:
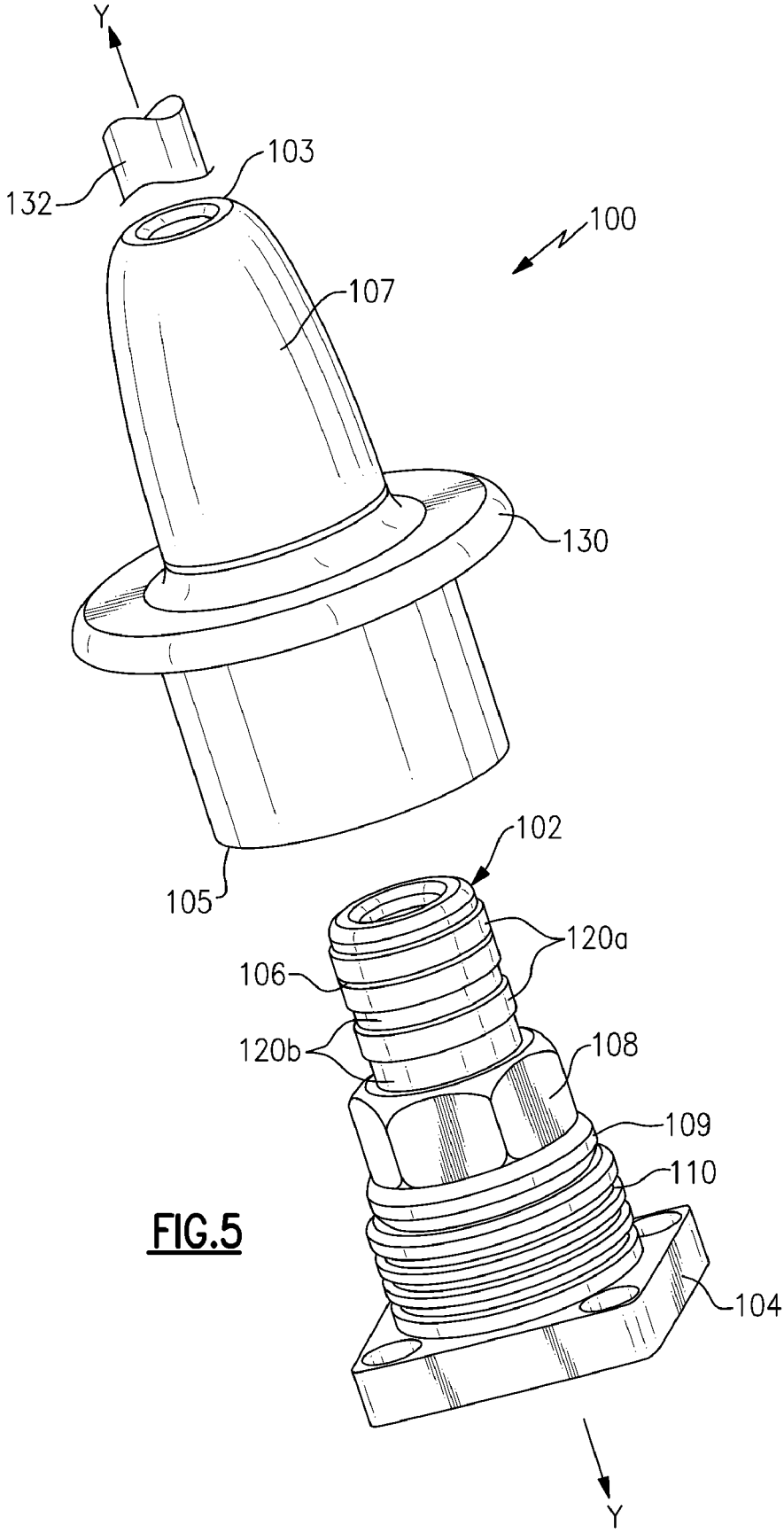
FIGS. 5 and 6 are partially exploded perspective views thereof.
Figure 6:
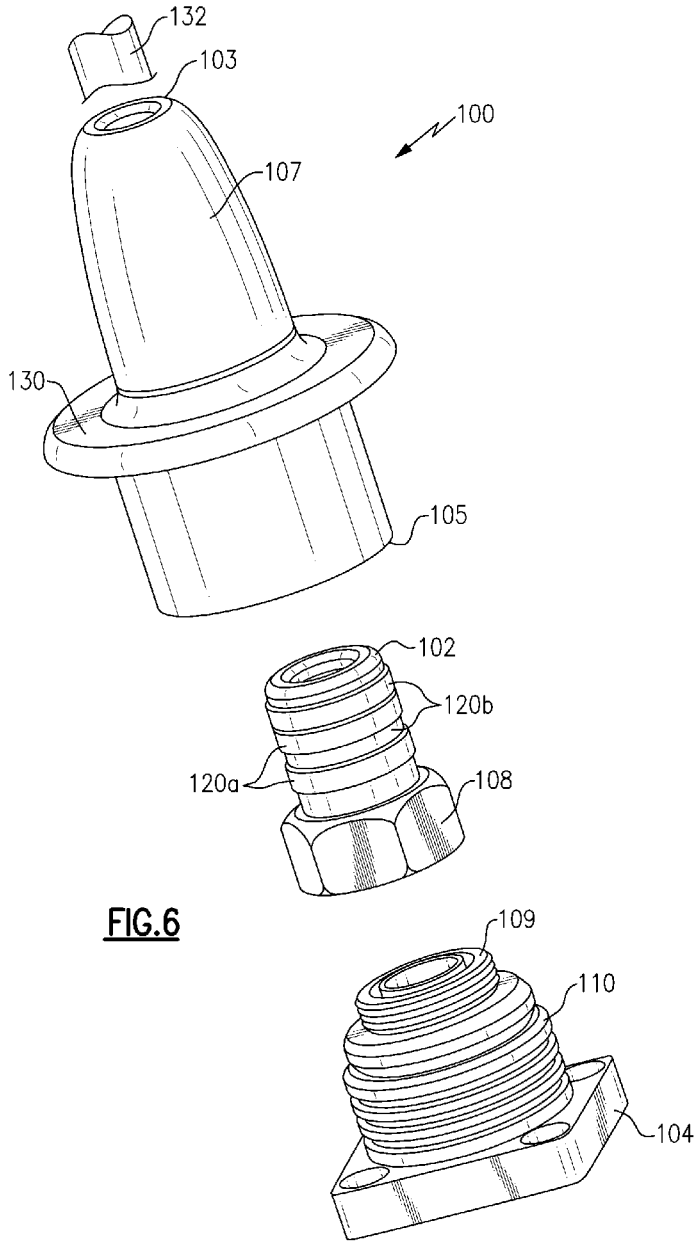
Figure 7:
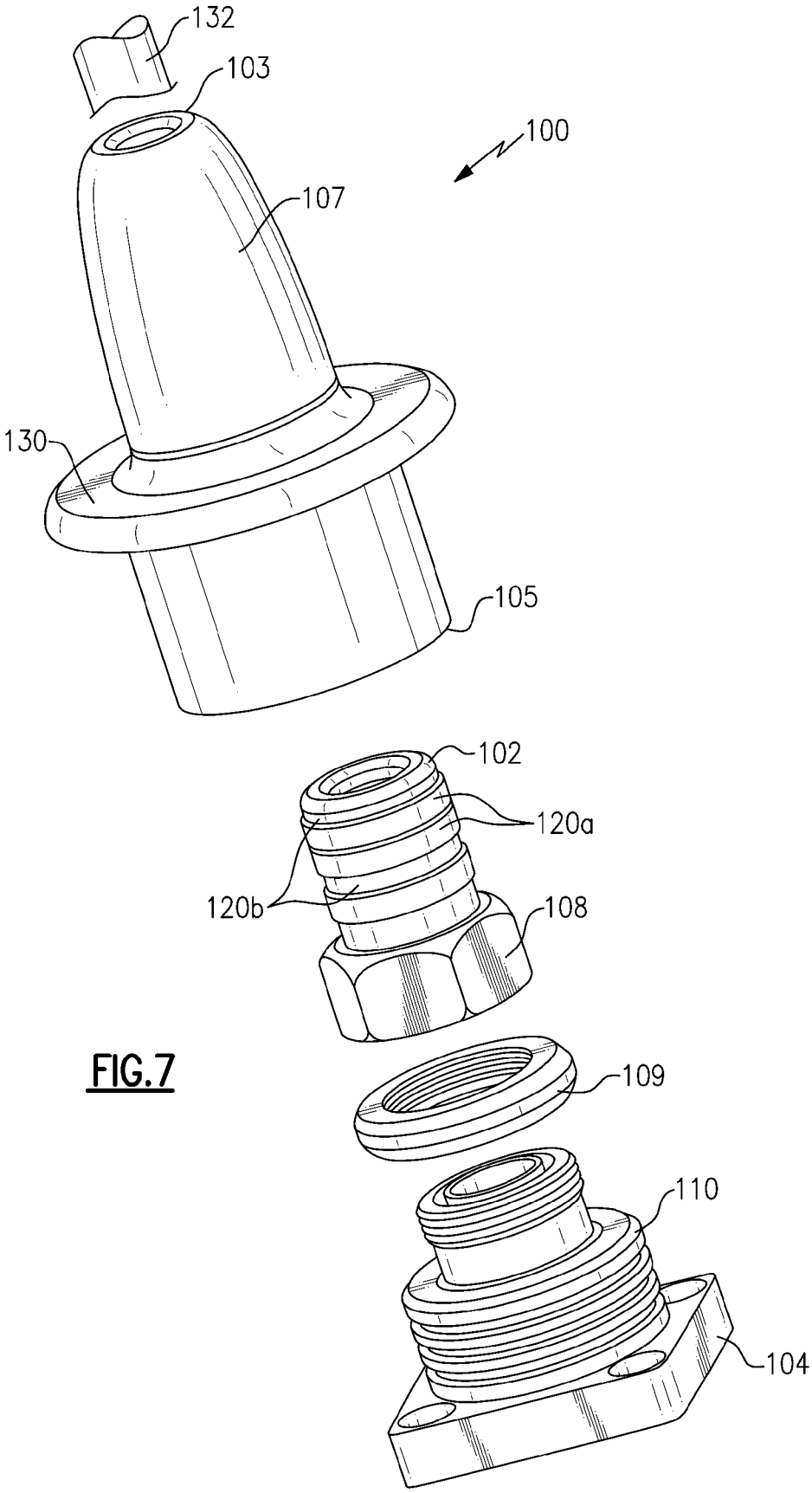
FIG. 7 is a fully exploded perspective view thereof.

Referring now to the drawing figures in which like reference numerals refer to like parts throughout, there is seen in FIG. 1 a cover, designated generally by reference numeral 10, adapted to be placed in secure and sealing relation over a connector 12, such as (a 5-series connector manufactured by John Mezzalingua Associates, Inc. of East Syracuse, N.Y. that is adapted to terminate a ⅞" cable). Connector 12 terminates on a bulkhead 13. In the embodiment of FIG. 1, cover 10 comprises an elongated body composed of a rubber material that exhibits a low modulus of elasticity over an extended temperature range, preferably a silicone rubber, that extends along a longitudinal axis X-X, a cable end 14, bulkhead end 16, exterior surface 18, interior surface 20, and wedge shaped wings 22 extending from opposing sides of exterior surface 18 that provide a gripping surface for a tool or manual engagement, such as pliers or a user's fingers, used to remove cover from covering relation to connector 12. The rubber composition of the cover permit it to elastically deform to the connector and other elements that it covers (e.g., the bulkhead), as will be described in greater detail hereinafter, when being installed or removed.

A series of longitudinally and sequentially spaced grooves 24 are formed in interior surface 20, proximate cable end 14, and extend over a predetermined distance. Notably, grooves 24 are not threads as they are not a continuous helix, but rather spaced apart, parallel grooves that function as small reservoirs for any moisture that may infiltrate the open cable end 14 of cover 10, as will be described in greater detail hereinafter. In the field, scratches or other material removal occurs in the jacket of a cable, and moisture may sometimes infiltrate through those scratches and into the seal. Grooves 24 (and the grooves in the other disclosed embodiments) are intended to minimize the effects of any such moisture migration.

With continued reference to FIG. 1, connector 12 extends outwardly from bulkhead 13 along axis X-X. Bulkhead 13 includes a shank portion 28 that is either integral therewith or comprised of a separate element preferably composed of rubber. If shank portion 28 is integral with bulkhead 13, a rubber gasket 26 is preferably placed in sealing relation at the interface of shank portion 28 and the neck 29 of bulkhead 13. Shank portion 28 is of a diameter having a dimension at least as large as, and preferably larger than the maximum width of coupling element/nut 30 (which is the next widest part of the connector), thus creating the connector's maximum width dimension at the interface of connector 12 and bulkhead 13.

The interior surface 20 of cover 10 includes a first region 32 that is of an essentially constant cross-sectional diameter and extends from cable end 14 to a first shoulder 34 from which it then tapers uniformly (although a stepped shoulder could apply equally) increasing the interior diameter to a second (medial) region 36 of interior surface 20 where it again remains essentially constant for a predetermined length. Second region 36 tapers outwardly (although it could be stepped instead of tapered) at a second shoulder 38 to a third region 40 that extends at a uniform cross-sectional diameter for the remainder of the cover's length until terminating at bulkhead end 16. These distinct regions of respective cross-sectional diameters securely envelop connector 12 and form seals at multiple points along the connector as will be described hereinafter.

To use cover 10, the cover would first be fully slid (cable end 14 first) over a cable 41 that is to be terminated in connector 12, leaving the terminal end of cable 41 exposed. As the cover is designed to have an interference fit with cable 41, it may be useful to apply a small amount of grease to the outside of the cable jacket to assist in pulling the cover over the cable. Cable 41 may then be terminated and attached to connector 12 in a conventional manner. Cover 10 would then be manually slid over connector 12 until its bulkhead end 16 preferably abuts, but at least overlapping with bulkhead 13. When cover 10 is fully positioned over connector 12, first region 32 tightly enwraps cable 41 with shoulder 34 positioned adjacent the terminating end of connector 12, thereby forming a seal between cable 41 and cover 10. If moisture does infiltrate the seal formed between cable 41 and cover 10 (due, for instance, to scratches or other removal of material that often occurs with the cable's jacket), the grooves 24 in first region 32 function as small reservoirs. Medial region 36 extends in tightly covering relation to the majority of connector 12, including its coupling element/nut 42 (although illustrated as a nut, various types of coupling elements are conventionally used on cable connectors of the type herein described) and the interface ring 44 that interfaces connector 12 with bulkhead 13, with a seal being formed at the junction of the interface ring 44 and medial region 36. Shoulder 38 tapers outwardly (Although it could be stepped instead of tapered) to accommodate shank portion 28 with third region 40 adapted to cover the shank portion 28 until the corner terminates in abutting relation to bulkhead 13, with seals being formed between shank portion 28 and cover 10 and between bulkhead 13 and cover 10.

With reference to FIGS. 4-7, an embodiment of a second cover 100 is provided. Cover 100, like cover 10, is adapted for placement in secure and sealed covering relation over a connector 102, such as a series 4 connector, manufactured and sold by John Mezzalingua, Associates, Inc. that is for use with a smaller cable (e.g., ½") than is connector 12. However, cover 100, like cover 10, is adapted to envelop a connector that terminates in a bulkhead 104. Connector 102 comprises a connector portion 106, a coupling element/nut 108 (although illustrated as a nut, various types of coupling elements are conventionally used on cable connectors of the type herein described), and interface ring 109 and an enlarged shank portion 110 (that, like shank portion 26, may be integral with or a separate, preferably rubber, element; if integral, a rubber gasket would preferably be placed at the interface of the shank portion and connector), and bulkhead 104.

Connector 100 comprises cable and bulkhead ends 103, 105, respectively, exterior and interior surfaces 107, 112, respectively, and a series of grooves 114 formed in longitudinally spaced relation to one another in interior surface 112 proximate, cable end 106. Grooves 114 serve as reservoirs in the event of moisture migration through cable end 106 to assist in preventing the moisture from leaching into connector 102.

The interior surface 112 of cover 100 includes a first region 116 of an essentially constant diameter that extends from cable end 106 to a first shoulder 115 from which it steps outwardly to an increased cross-sectional diameter that extends essentially uniformly in a second or medial region 118. Notably, the portion of connector 102 that second region 118 is adapted to cover comprises different diameter rings 120*a* and 120*b* with 120*a* being of slightly smaller diameter than 120*b*. The diameter of second region 118 approximates that of rings 120*a* and the pliable nature of cover 100 permits the material to deform to accommodate the relevant portion of connector 102 and consequently securely envelop the larger diameter rings 120*b*, creating tight seals at the transitions between rings 120*a* and 120*b*. Medial region 118 next steps outwardly at a shoulder 122 to a third (also medial) region 124 that is adapted to be positioned in covering relation over nut 108 and interface ring 109. Third region 124 then steps outwardly at shoulder 126 to a fourth region 128 that is adapted to envelop shank portion 110 and terminate at bulkhead 104.

Unlike the wings 22 of cover 10, cover 100 includes a ring 130 that extends around exterior surface 107 in a plane that is essentially transverse to the longitudinal axis Y-Y of cover 100 and is positioned at about the midpoint along the length of cover 100. Ring 130 serves principally as a drip edge to direct any rain water or other moisture away from the interfaces between the cover and the connector/cable. Ring 130 could also serve to provide a gripping surface for a tool used to remove cover 100 from connector 102.

The manner of using cover 100 is the same as that for cover 10; namely sliding cover 100 (cable end first) entirely over a cable 132, and then terminating the cable in connector 102 in a conventional manner. Cover 100 is then slid downwardly in enveloping relation to connector 102 until its distal end 108 preferably abuts, but at least overlaps with bulkhead 104. When cover 100 is fully positioned over connector 102, first region 116 tightly enwraps cable 132 with shoulder 115 positioned adjacent the terminating end of connector 102, thereby forming a seal between cable 132 and cover 100. If moisture does infiltrate the seal formed between cable 132 and cover 100, the grooves 114 function as small reservoirs. Second region 118 extends in tightly covering relation to the majority of connector 102 that extend outwardly from nut 108, with shoulder 120 positioned in sealed relation to nut 108. Third region 124 then extends in sealed relation to nut 108 and interface ring 109, and shoulder 126 tapers (or steps) outwardly such that fourth region 128 can accommodate and extend in sealed relation to shank portion 110 until it terminates in abutting relation to bulkhead 104, with seals being formed between shank portion 110 and cover 100 and between bulkhead 104 and cover 100.

Figure 8:
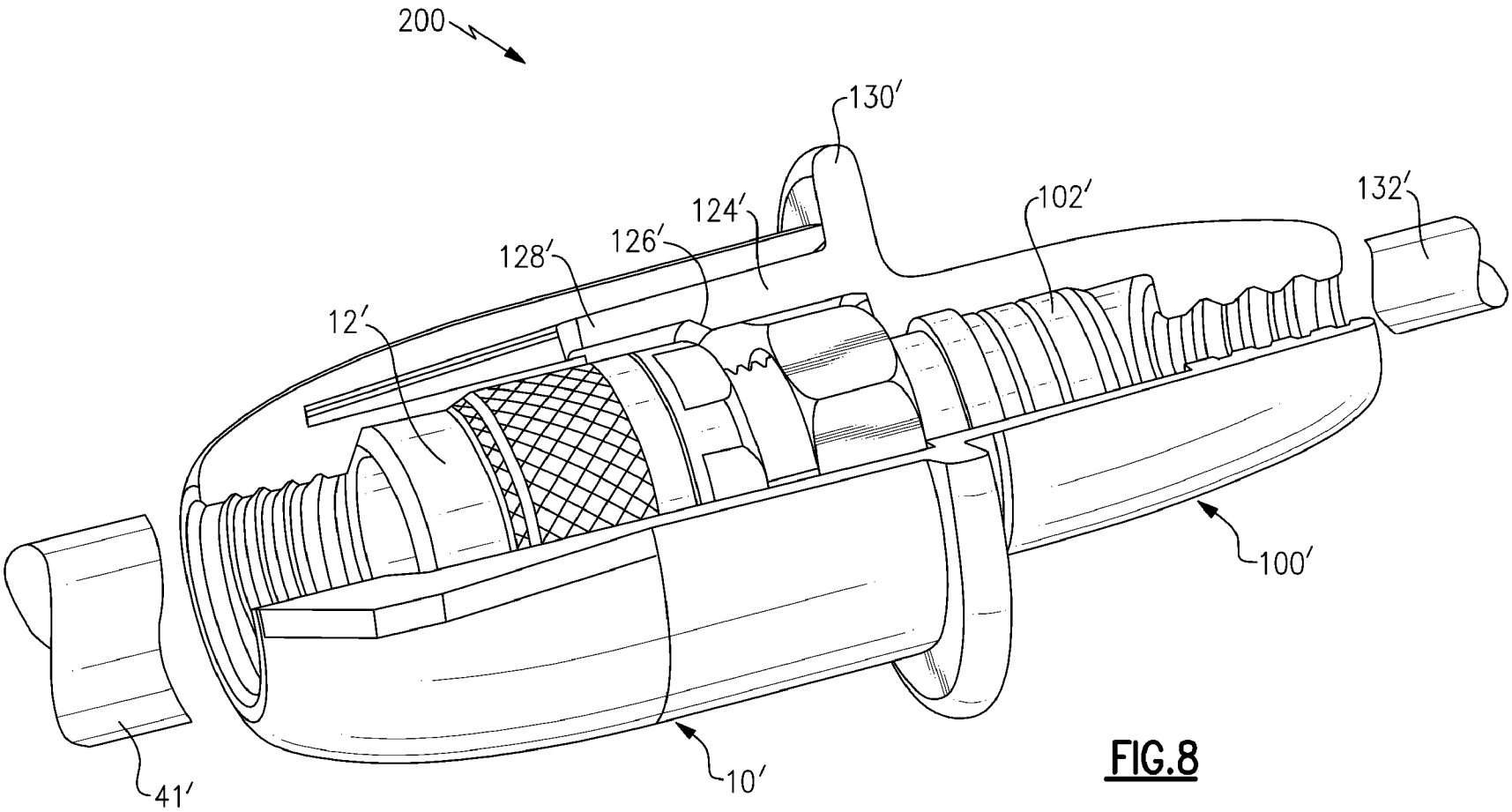
FIG. 8 is a partially cut-away perspective view of a third embodiment of a system of covers for providing cover to first and second cable connectors used to splice two differently sized cables.
Figure 9:
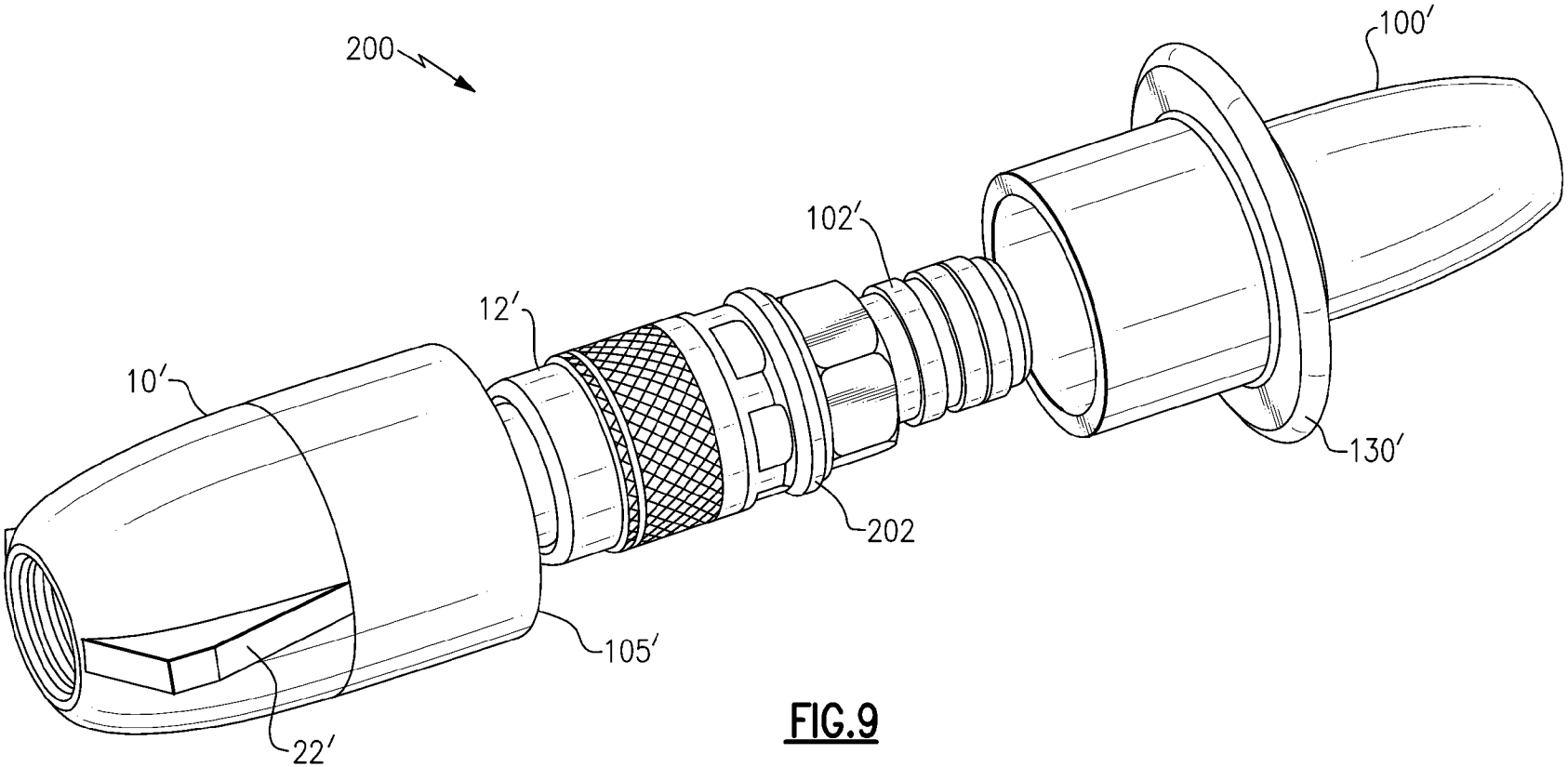
FIG. 9 is a partially exploded perspective view thereof.
Figure 10:
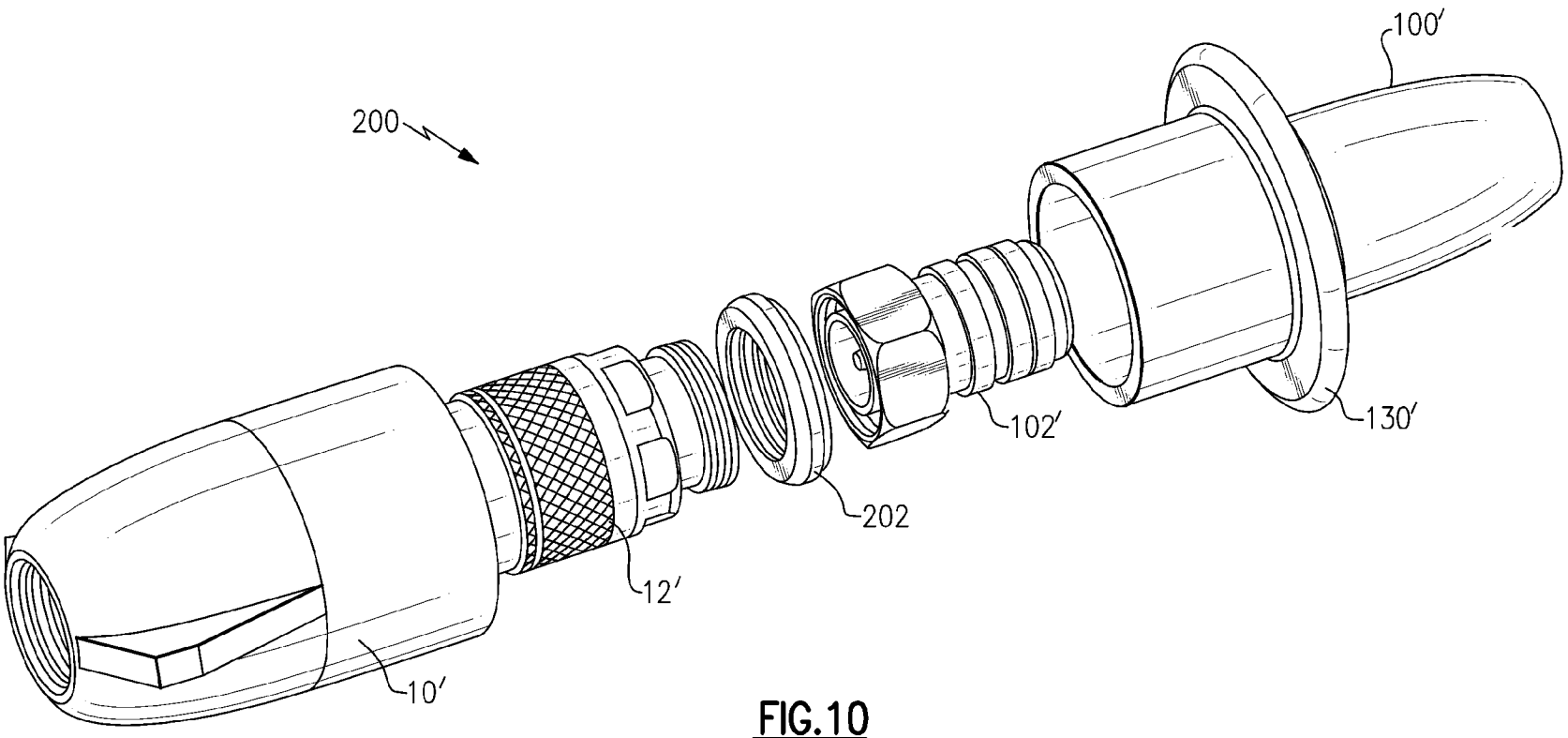
FIG. 10 is a fully exploded perspective view thereof.
Figure 11:
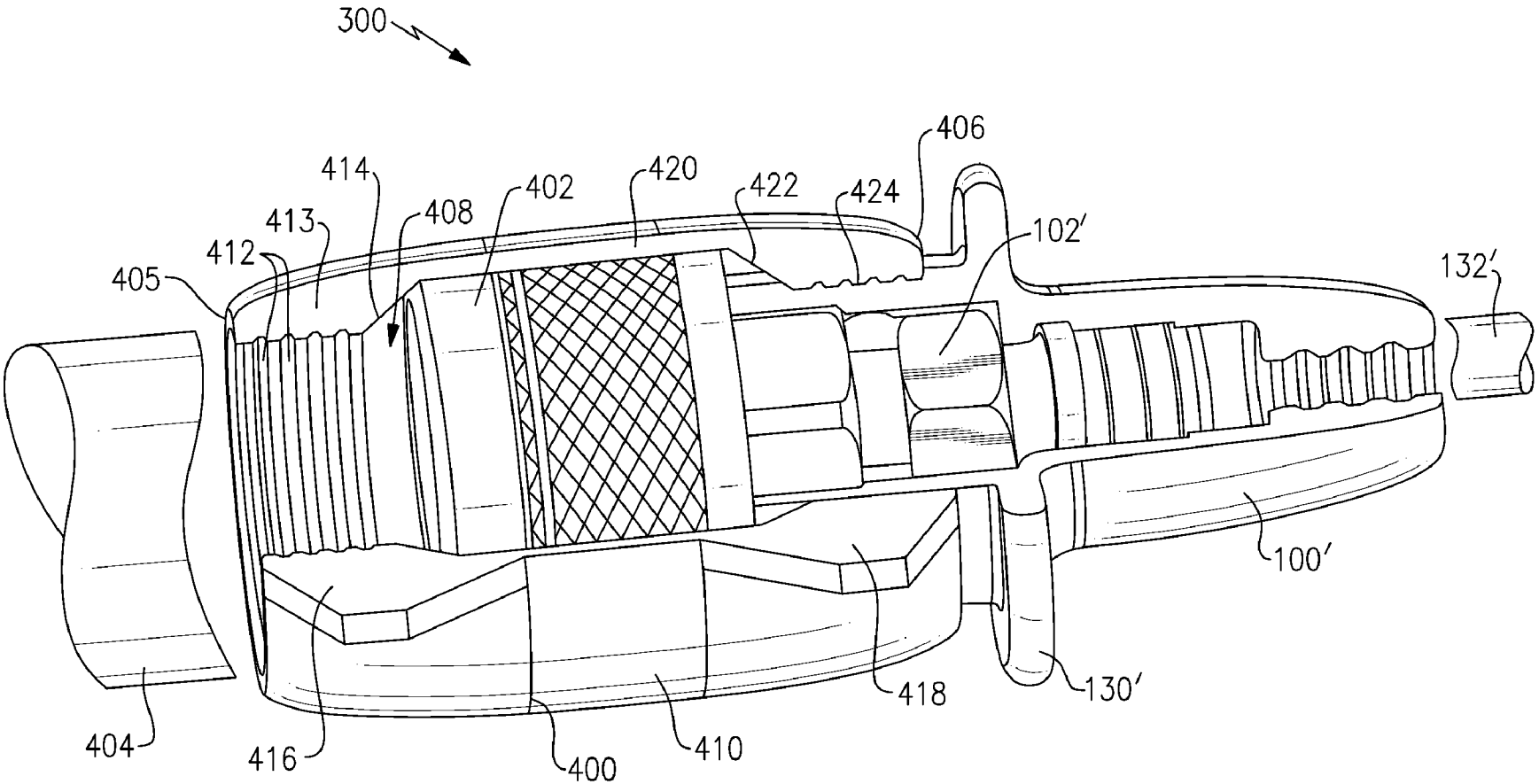
FIG. 11 is a partially cut-away perspective view of a fourth embodiment of a system of covers for providing cover to first and second cable connectors used to splice two differently sized cables.
Figure 12:
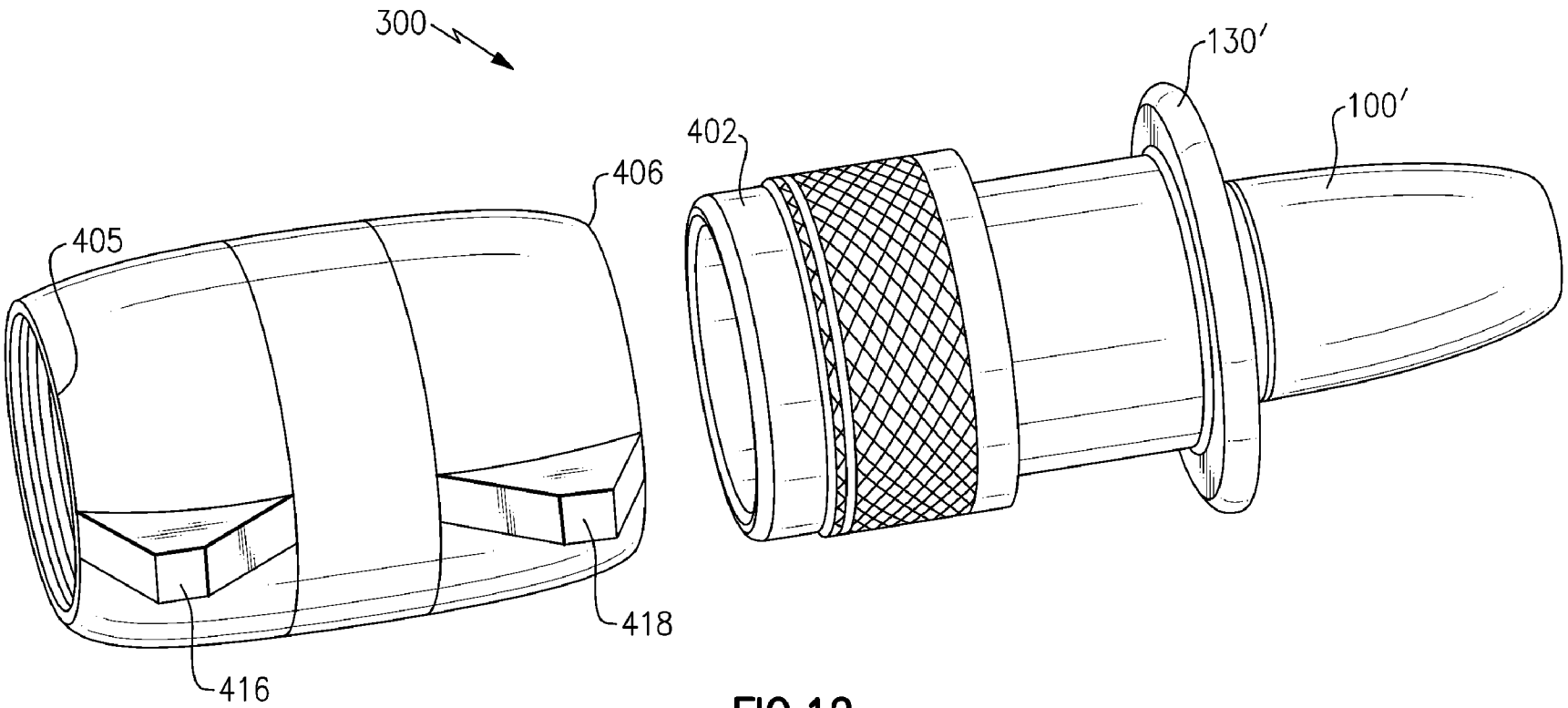
FIGS. 12 and 13 are partially exploded perspective views thereof.
Figure 13:
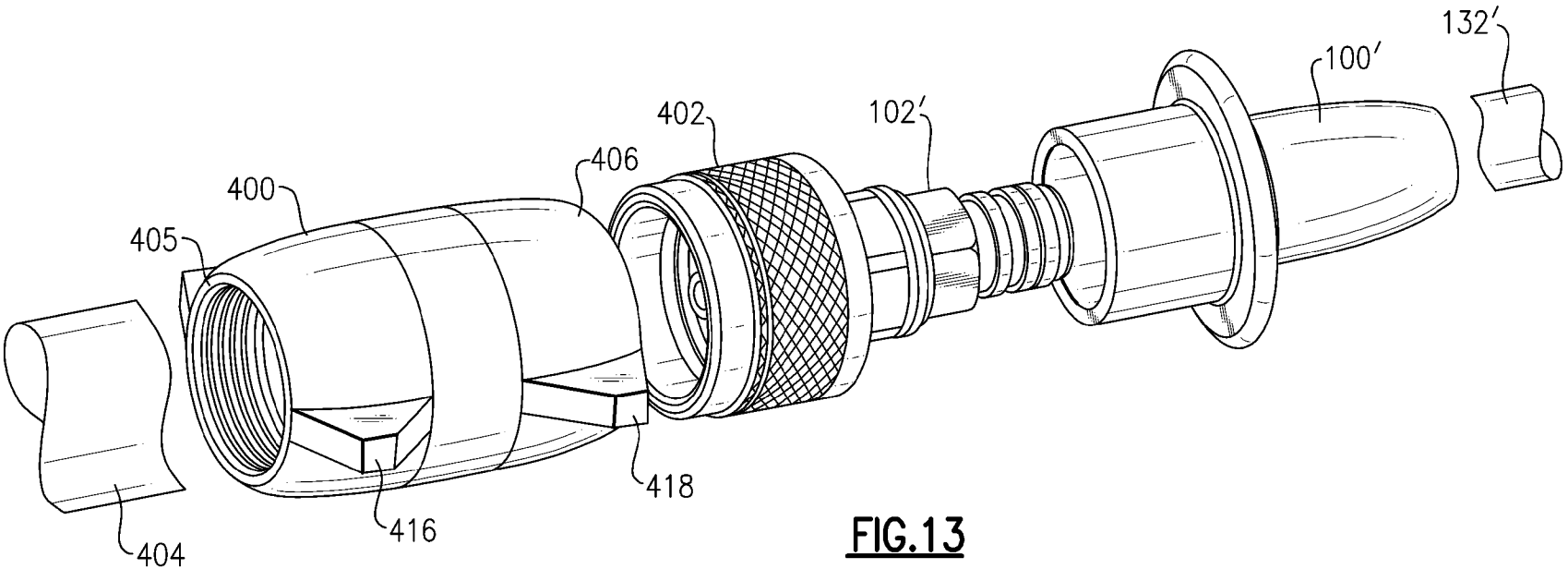
Figure 14:
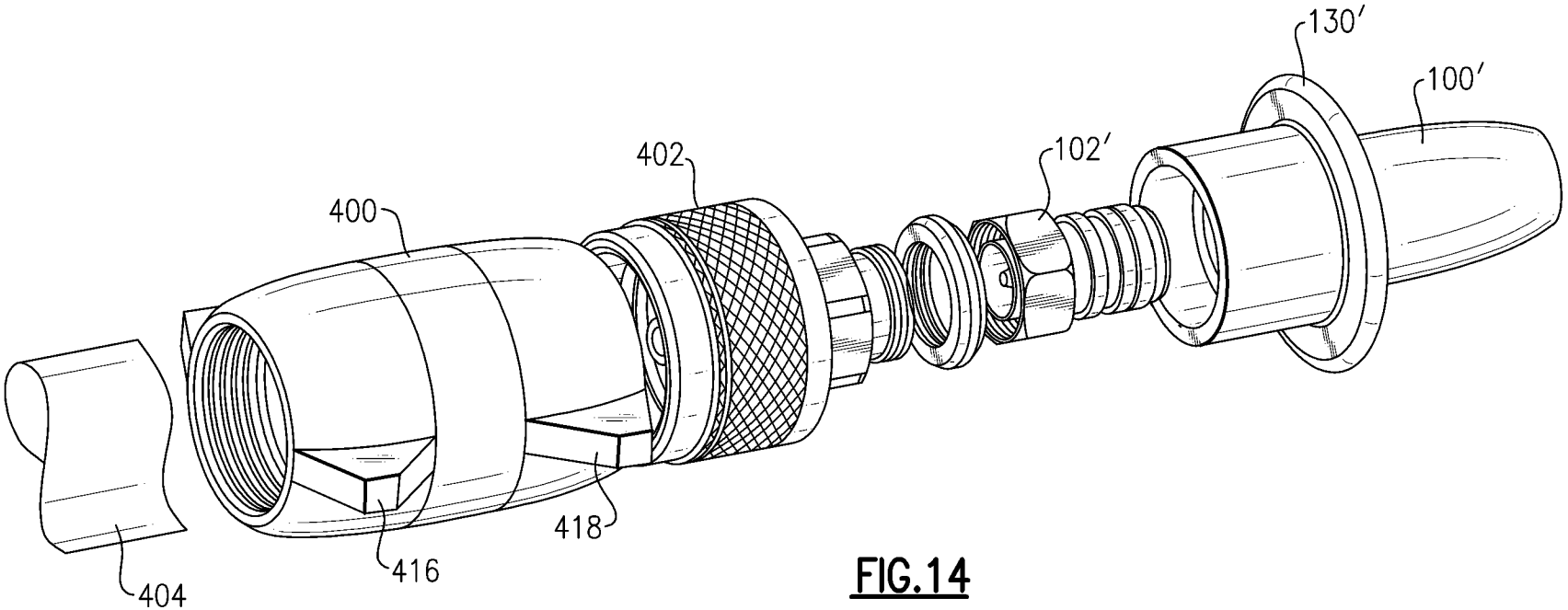
FIG. 14 is a fully exploded perspective view thereof.

While covers 10 and 100 are both adapted to be placed in covering relation to connectors that terminate in a bulkhead, with reference to FIGS. 8 to 14 there is seen a system for covering a pair of connectors that are used to splice together two differently sized cables. FIGS. 8-10 illustrate a system 200 of using covers 10 and 100 (that will be designated 10' and 100' for purposes of differentiating the bulkhead embodiments from the splice embodiment) to splice cables that terminate in connectors 12' and 102' (again, the connectors 12' and 102' are structurally the same as connectors 12 and 102 with the difference being the lack of a bulkhead for terminating the connectors since the connectors are joined together). The structures of covers 10' and 100' are the same as described above for covers 10 and 100, but with a different method of use and resultant arrangement.

System 200 comprises cover 10' adapted to cover connector 12' and cover 100' that is adapted to cover connector 102'. In use, cover 10' is first slide entirely over cable 41' which may then be terminated to connector 12' in a conventional manner, and likewise, cover 100' may be slid over cable 132' which may then be terminated to connector 102'. Next, connectors 12' and 102' are interconnected by applying an appropriate amount of torque to secure the interconnection, with a gasket 202 optionally being positioned between the two to enhance the sealing at the interface of the connectors. Cover 100' may then be slid downwardly into enveloping relation to connector 102'. Finally, cover 10' may be slide over connector 12' with fourth region 128' and at lest a portion of third region 124' of cover 100' being telescopically engaged within third region 40'. In addition to the seals created by covers 10' and 100' as previously described, an additional seal is created at the interface of end 105' and cover 100'.

System 300, illustrated in FIGS. 11-14, comprises a cover 400 that is adapted to cover a connector 402 (such as a series 7 connector manufactured by John Mezzalingua Associates, Inc.) in which a cable 404 (e.g., a 1⅝" cable) may be terminated, and cover 100' that provides, as previously described, cover for connector 102' that in this embodiment is adapted to be spliced to connector 402. With regard to cover 400, it comprises cable and splice ends 405, 406, respectively, and interior and exterior surfaces 408, 410, respectively. A series of grooves 412 are formed in interior surface 408 in parallel spaced relation to one another in the first region 413 of cover 400 that extends from cable end 408 to a first shoulder 414. Grooves 412, like the other grooves described herein, serve as reservoirs for any moisture that migrate into cover 400 at its interface with cable 404.

While cover 10 includes axial symmetric wings 22, cover 400 includes two sets of axially symmetric positioned wings 416 and 418 that provide gripping surfaces for a tool to assist in pulling cover 400 off connector 402 or pull it into covering relation to connector 402. The extra set of wings is provided due to the larger size cable 404 and connector 402 that cover 400 is adapted to seal as compared to those associated with cover 10, but also permits this cover to be installed in either orientation (as it is symmetrical about its transverse mid-plane). Interior surface 408 of cover 400 comprises three distinct regions: first region 413, (second) region 420 that extends from shoulder 414 to a second shoulder 422, and a third region 424 that extends between shoulder 422 and splice end 406. Shoulder 414 tapers outwardly from first region 413 to second region 420 which then extends with an essentially constant cross-sectional diameter, and shoulder 422 then tapers back inwardly where third region 424 then continues with an essentially constant cross-sectional diameter. The tapering of shoulders assists in the removal and installation of cover 400 (by providing a draft), but it is conceivable that the shoulders be stepped instead of tapered.

In use, cover 400 is slid fully over cable 404, while cover 100' is slid over cable 132'. Cover 100' may then be slid over connector 102 in the manner previously described, and cover 400 may be slid over connector 402 such that first region 413 envelops cable 404, second region 420 is positioned in covering relation to connector 420 and third region 424 engulfs (or telescopically engages with) the exterior surface of the lower portion of cover 100' with splice end 406 abutting or nearly abutting ring 130'.

Although several embodiments of the present invention have been specifically described herein, the full scope and spirit of the present invention is not to be limited thereby, but instead extends to the metes and bounds as defined by the appended claims.

What is claimed is:

1. A cover for a connector adapted to terminate a cable, wherein the connector includes a body portion and a coupling element and is adapted to terminate in a bulkhead with a shank portion extending outwardly therefrom, said cover comprising:

a. a unitary elongated body member having cable and bulkhead ends, interior and exterior surfaces, said elongated body extending along a longitudinal axis; and b. wherein said interior surface includes a first region adapted to cover at least a portion of the signal carrying cable and extending from said cable end to a first shoulder, said first region being of a minimum, first cross-sectional diameter and including a plurality of grooves formed therein, a second region adapted to cover at least the connector body portion and coupling element and that extends from said first shoulder to a second shoulder, said second region being of an minimum, second cross-sectional diameter that is greater than said minimum, first cross-sectional diameter, and a third region adapted to cover the shank portion and that extends from said second shoulder to said bulkhead end, said third region being of a minimum, third cross-sectional diameter that is greater than said minimum, second cross-sectional diameter.

2. The cover according to claim 1, wherein said cover is composed of a rubber material.

3. The cover according to claim 2, wherein said rubber material is a silicone rubber.

4. The cover according to claim 1, wherein each of said plurality of grooves extends in spaced parallel relation to the others.

5. The cover according to claim 4, further comprising at least one wing formed on said exterior surface.

6. The cover according to claim 1, further comprising at least one wing formed on said exterior surface.

7. A cover for a connector adapted to terminate a cable, wherein the connector includes a body portion and a coupling element and is adapted to terminate in a bulkhead having a shank portion extending outwardly therefrom, said cover comprising:

a. an elongated body member having cable and bulkhead ends, interior and exterior surfaces, said elongated body extending along a longitudinal axis; and b. wherein said interior surface includes a first region adapted to cover at least a portion of the signal carrying cable and extending from said cable end to a first shoulder, said first region being of a minimum, first cross-sectional diameter, a second region adapted to cover at least the connector body portion and that extends from said first shoulder to a second shoulder, said second region being of an minimum, second cross-sectional diameter that is greater than said minimum, first cross-sectional diameter, a third region adapted to cover at least the coupling element and extending from said second shoulder to a third shoulder, said third region being of a minimum, third cross-sectional diameter that is larger than said second cross-sectional diameter, and a fourth region adapted to cover the shank portion and that extends from said third shoulder to said bulkhead end, said fourth region being of a minimum, fourth cross-sectional diameter that is greater than said minimum, third cross-sectional diameter.

8. The cover according to claim 7, wherein said cover is composed of a rubber material.

9. The cover according to claim 8, wherein said rubber material is a silicone rubber.

10. The cover according to claim 7, wherein said first region includes a plurality of grooves formed therein, wherein each of said grooves extends in spaced parallel relation to the others.

11. The cover according to claim 10, further comprising at least one wing formed on said exterior surface.

12. The cover according to claim 7, further comprising a ring formed on said exterior surface.

13. The cover according to claim 12, wherein said ring extends in a plane that is transverse to said longitudinal axis.

* * * * *